US010746144B2

(12) United States Patent
Kurz

(10) Patent No.: US 10,746,144 B2
(45) Date of Patent: Aug. 18, 2020

(54) FUEL INJECTOR

(71) Applicant: Robert Bosch GmbH, Stuttgart (DE)

(72) Inventor: Michael Kurz, Plochingen (DE)

(73) Assignee: Robert Bosch GmbH, Stuttgart (DE)

( * ) Notice: Subject to any disclaimer, the term of this patent is extended or adjusted under 35 U.S.C. 154(b) by 5 days.

(21) Appl. No.: 16/065,373

(22) PCT Filed: Nov. 7, 2016

(86) PCT No.: PCT/EP2016/076773
§ 371 (c)(1),
(2) Date: Jun. 22, 2018

(87) PCT Pub. No.: WO2017/108244
PCT Pub. Date: Jun. 29, 2017

(65) Prior Publication Data

US 2019/0017476 A1 Jan. 17, 2019

(51) Int. Cl.
*F02M 43/04* (2006.01)
*F02M 51/06* (2006.01)
*F02M 45/08* (2006.01)

(52) U.S. Cl.
CPC ..... *F02M 43/04* (2013.01); *F02M 45/086* (2013.01); *F02M 51/0664* (2013.01); *F02M 51/0671* (2013.01)

(58) Field of Classification Search
CPC .... F02M 43/04; F02M 43/14; F02M 51/0671; F02M 51/0664; F02M 45/086;
(Continued)

(56) References Cited

U.S. PATENT DOCUMENTS 5,669,334 A 9/1997 Schoenfeld et al.
10,247,112 B2 * 4/2019 Wickstone ..... F02M 45/083
(Continued)

FOREIGN PATENT DOCUMENTS

CA 2884945 5/2015
DE 102013014329 2/2015
(Continued)

OTHER PUBLICATIONS

International Search Report for Application No. PCT/EP2016/076773 dated Feb. 3, 2017 (English Translation, 2 pages).

*Primary Examiner* — George C Jin
(74) *Attorney, Agent, or Firm* — Michael Best & Friedrich LLP

(57) ABSTRACT

The invention relates to a fuel injector for injecting two liquid and/or gaseous fuels with an injector housing (1), comprising a nozzle body (2) and a valve body (3). A first nozzle needle (7), arranged such that it can move in a stroke-like manner, is arranged in said injector housing (1) for opening and closing an injection cross-section (27). The first nozzle needle (7) is thereby designed as a hollow needle in which a second nozzle needle (8), arranged such that it can move in a stroke-like manner, is arranged. Same cooperates with an inner nozzle seat (25) formed in the first nozzle needle (7) to open and close at least one injection opening (35). The first nozzle needle (7) and the second nozzle needle (8) border an injection chamber (20) that can be filled with fuel via a supply throttle (36). In addition, in an upper switch position, the second nozzle needle (8) is in contact with a seal seat (38) and thereby separates a connection between the injection chamber (20) and the supply throttle (36).

15 Claims, 4 Drawing Sheets

(58) Field of Classification Search
CPC ..... F02M 45/083; F02M 61/10; F02M 61/16; F02M 61/002; F02M 61/045; F02M 37/221; F02M 37/0064; F02B 7/02; F02D 17/0215; F02D 41/0027; F02D 41/38; F02D 41/3836; F02D 19/081; F02D 19/061; F02D 19/0652; F02D 19/0689; F02D 19/0694; F02D 35/153; F02D 36/005
See application file for complete search history.

(56) References Cited

U.S. PATENT DOCUMENTS

| | | | | |
|---|---|---|---|---|
| 2009/0020631 | A1* | 1/2009 | Mashida | F02D 19/10 239/533.3 |
| 2010/0199948 | A1* | 8/2010 | Rogak | F02D 19/0647 123/304 |
| 2012/0097127 | A1 | 4/2012 | Firey | |
| 2014/0123937 | A1* | 5/2014 | Wickstone | F02D 19/10 123/299 |

FOREIGN PATENT DOCUMENTS

| | | | |
|---|---|---|---|
| DE | 102014206210 | A1 | 10/2015 |
| DE | 102014225392 | | 6/2016 |

* cited by examiner

FUEL INJECTOR

BACKGROUND OF THE INVENTION

The invention relates to a fuel injector for injecting two liquid and/or gaseous fuels into a combustion chamber of an internal combustion engine.

DE 10 2013 014 329 A1 has disclosed a combustion method for an internal combustion engine which uses a dual-fuel injector for implementing different forms of fuel in one combustion chamber of an internal combustion engine. Here, in said dual-fuel injector, there is arranged a first nozzle arrangement, through which diesel fuel can flow into a combustion chamber, and a second nozzle arrangement, which can discharge gaseous fuel into the combustion chamber.

By means of a dual-fuel injector of said type, it is possible for an internal combustion engine, in particular a diesel/gas engine, to be operated both in a purely liquid-fuel operating mode and a combined liquid-fuel/gas operating mode. Both the duration and quantity and the sequence of the respective injections of liquid fuel/gas, and the mixture ratio, have a considerable influence on the ignition characteristics and thus the efficiency of the entire injection system.

SUMMARY OF THE INVENTION

The invention is based on the object of further developing a fuel injector for injecting two liquid and/or gaseous fuels, in a manner which combines the two fundamentally different injection types in one injector and improves the ignition characteristics and thus the efficiency of the entire fuel injection system.

Said object is achieved in the case of the fuel injector according to the invention in that the fuel injector for injecting two liquid and/or gaseous fuels comprises an injector housing which comprises a nozzle body and a valve body, wherein, in the injector housing, there is arranged a first nozzle needle which is arranged such that it can perform stroke movements and which serves for opening and closing an injection cross section. Here, the first nozzle needle is formed as a hollow needle in which there is arranged a second nozzle needle which is arranged such that it can perform stroke movements. Said second nozzle needle, for the purposes of opening and closing at least one injection opening, interacts with an inner nozzle seat formed in the first nozzle needle. Furthermore, the first nozzle needle and the second nozzle needle delimit an injection chamber which can be filled with fuel via an inflow throttle. The second needle, in an upper switching position, bears against a sealing seat and thereby shuts off the connection between the injection chamber and the inflow throttle.

Owing to the shutting-off of the connection of the injection chamber and of the inflow throttle, the follow-on flow of fuel is prevented. In this way, the injection of said fuel into a combustion chamber of an internal combustion engine can be ended without the second nozzle needle having to reverse its movement.

In a first advantageous further development of the invention, it is provided that, in the interior of the valve body, there is arranged a valve element which has a passage bore of multiply stepped form. Both the first nozzle needle and the second nozzle needle project into said blind bore.

Here, it may advantageously be provided that the sealing seat is formed on the valve element, in order to realize a compact construction. Here, the valve element can be easily separately fastened. Furthermore, the inflow throttle may be formed in the valve element.

It may furthermore advantageously be provided that the valve element is forced in the direction of the nozzle seat by means of a spring. This permits flexible and very easy fixing of the valve element in the fuel injector without additional fixing, for example by means of a welding process.

In a further advantageous refinement of the invention, it is provided that the first nozzle needle is of stepped form on the outer circumference in order to create space for a further chamber in which further components can be accommodated, or which can be used for realizing a slimmer design of the injector.

In a further refinement of the invention, it is advantageously provided that the at least one injection opening is formed on that face side of the first nozzle needle which faces toward a combustion chamber. There is thus no need for a separate component, which permits a simpler manufacturing process.

In a further development of the concept of the invention in terms of construction, it is provided that the nozzle body and the first nozzle needle delimit a prechamber. In said prechamber, there is provided a spring which forces the first nozzle needle in the direction of the combustion chamber.

It may furthermore be provided that, in the prechamber, there is arranged a separating device, in particular a diaphragm, which separates the liquid and/or gaseous fuels from one another, such that the two fuels do not mix despite the inevitable leakage gaps.

In a further refinement of the invention, it is advantageously provided that the valve element and the second nozzle needle, in the upper switching position, delimit a partial chamber. Said partial chamber forms a part of the injection chamber, wherein, in an advantageous refinement of the concept of the invention, it is provided that the inflow throttle opens into the partial chamber. The precise end of the injection can thereby be ensured.

In a further refinement of the concept of the invention, it may advantageously be provided that the second nozzle needle is forced in the direction of the inner nozzle seat by means of a restoring spring.

In a further advantageous refinement of the invention, it is provided that the first nozzle needle controls a gaseous fuel flow into the combustion chamber and/or that the second nozzle needle controls a liquid fuel flow into the combustion chamber.

BRIEF DESCRIPTION OF THE DRAWINGS

Further advantages, features and details of the invention will emerge from the following description of preferred exemplary embodiments and from the drawings, in which.

Elements of identical function are denoted by identical reference designations in the figures.

DETAILED DESCRIPTION

Figure 1:
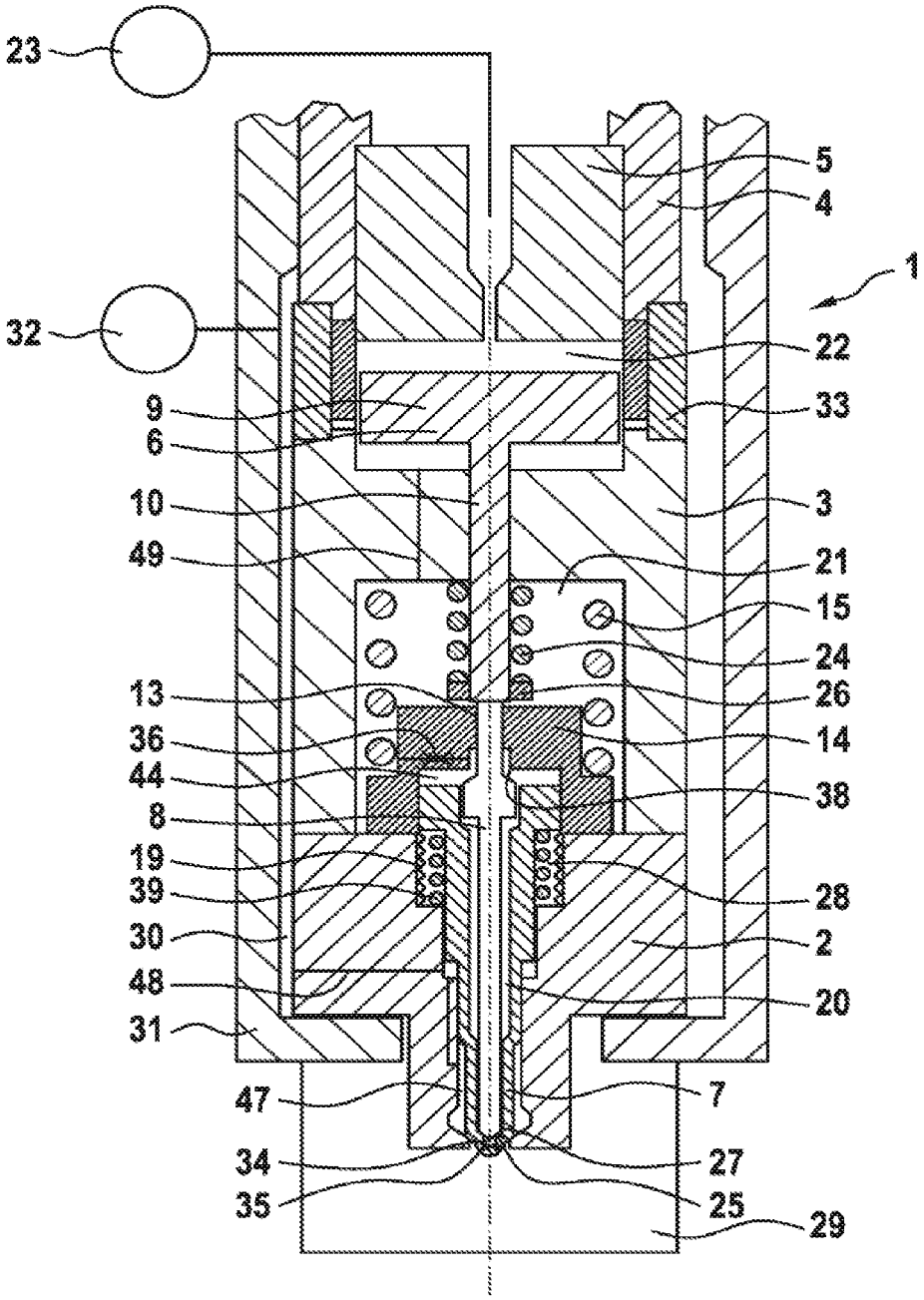
FIG. 1 shows a schematic longitudinal section through a fuel injector according to the invention, FIG. 2(*a*) shows an enlarged illustration of the fuel injector according to the invention in the region of the first nozzle needle and of the second nozzle needle, wherein the first nozzle needle closes an injection cross section and the second nozzle needle closes at least one injection opening, FIG. 2(*b*) shows an enlarged illustration of the fuel injector according to the invention in the region of the first nozzle needle and of the second nozzle needle, wherein the first nozzle needle closes the injection cross section and the second nozzle needle has opened up the at least one injection opening, FIG. 2(*c*) shows an enlarged illustration of the fuel injector according to the invention in the region of the first nozzle needle and of the second nozzle needle, wherein the first nozzle needle has opened up the injection cross section and the second nozzle needle closes the at least one injection opening, FIG. 3(*a*) shows a diagram in which, firstly, the stroke travel H of the first nozzle needle and the stroke travel h of the second nozzle needle are plotted versus the time t and in which, secondly, the injection quantity m of the fuel and of the gas respectively are plotted as a function of the time t. This represents a first possible injection scenario as illustrated in FIG. 2, FIG. 3(*b*) shows a diagram in which, firstly, the stroke travel H of the first nozzle needle and the stroke travel h of the second nozzle needle are plotted versus the time t and in which, secondly, the injection quantity m of the fuel and of the gas respectively are plotted as a function of the time t. This represents a second possible injection scenario, wherein here, a multiple injection of the two fuels is realized.

FIG. 1 shows a fuel injector according to the invention composed of an injector housing 1, which comprises a nozzle body 2, a valve body 3 and a holding body 4. A magnet coil 33 is accommodated between the valve body 3 and the holding body 4. Furthermore, the fuel injector has an inner pole 5 and a magnet armature 6 composed of an armature plate 9 and an armature pin 10. Here, the valve body 3, the holding body 4 and the inner pole 5 delimit an armature space 22, in which the magnet armature 6 is arranged. The armature pin 10 protrudes into a passage bore 13 of the valve body 3 and, in so doing, projects into a pressure chamber 21, wherein said pressure chamber 21 is formed in the nozzle body 2 and in the valve body 3 and is delimited by the valve body 3. Via a rail 23, the armature chamber 22 can be filled with liquid fuel, wherein said liquid fuel can enter the pressure chamber 21 via an inflow throttle 49. Within the pressure chamber 21, aside from a restoring spring 24 which is fastened to a support sleeve 26, there is arranged a valve element 14 which, together with another body 2, delimits a partial chamber 44 of the pressure chamber 21. Also arranged in the pressure chamber 21 is a spring 15, which is supported on the valve element 14 and which forces the latter in the direction of the nozzle body 2 and thereby fixes said valve element in position. The partial chamber 44 of the pressure chamber 21 has a first nozzle needle 7, which is arranged such that it can perform stroke movements and which is formed as a hollow needle and in which there is arranged a second nozzle needle 8, which is arranged such that it can perform stroke movements. Here, the second nozzle needle 8 is guided with its face side facing toward the magnet armature in a passage bore 13 of the valve element 14, and is fixedly connected to the armature pin 10 of the magnet armature 6. The partial chamber 44 of the pressure chamber 21 is in turn divided into multiple individual chambers owing to the nozzle needle arrangements. Here, the nozzle body 2, together with the first nozzle needle 7, encloses both a prechamber 28 and a chamber 47 which, via an inflow duct 48, is connected to a gas chamber 30 which is formed between a clamping nut 31, the nozzle body 2, the valve body 3 and the holding body 4. The gas is fed into the gas chamber 30 by means of a gas supply 32. The prechamber 28 has a spring 39 and a separating device 19, in particular a diaphragm, which separates the liquid and/or gaseous fuels from one another.

The second nozzle needle 8, together with the first nozzle needle 7 and the valve element 14, forms an injection chamber 20. Said injection chamber is connectable via an inflow throttle 36 formed in the valve element 14 to the pressure chamber 21, and can thus be filled with the first fuel, preferably with liquid fuel. The first nozzle needle 7, in a lower switching position, with the aid of the spring 39, closes an injection cross section 27 formed in the nozzle body 2, via which injection cross section preferably gaseous fuel can be injected into a combustion chamber 29. The second nozzle needle 8 is forced by means of the restoring spring 24 in the direction of an inner nozzle seat 25 formed in the first nozzle needle 7, and in a lower switching position, closes at least one injection opening 35 which is formed in the first nozzle needle 7 and via which liquid fuel can flow into the combustion chamber 29.

Figure 2A:
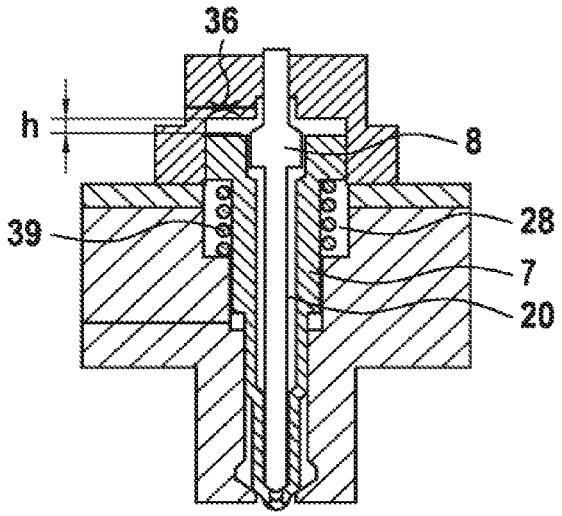
Figure 2B:
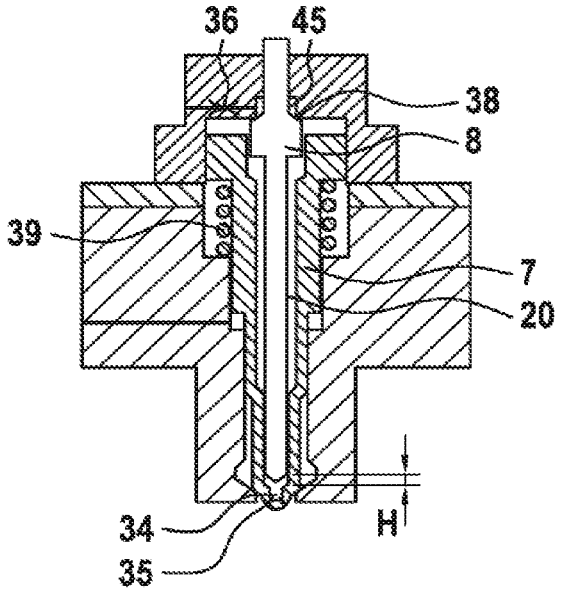
Figure 2C:
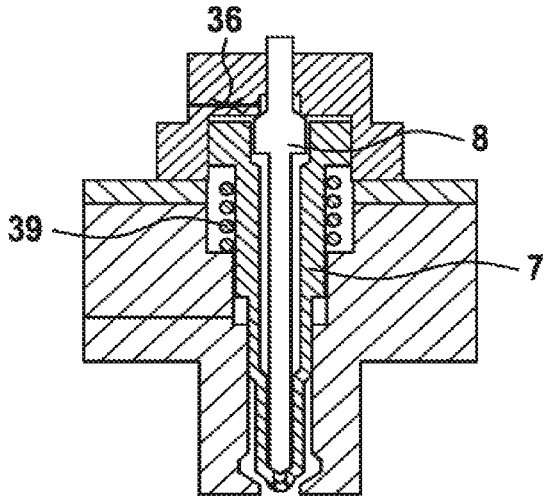

The fuel injector according to the invention functions as follows: when the magnet coil 33 is electrically energized, a magnetic force builds up in the inner pole 5, such that the magnet armature 6 and the second nozzle needle 8 fixedly connected thereto, as illustrated in FIG. 2(*a*), are pulled in the direction of the inner pole 5. In this way, the inner nozzle seat 25 is opened up, and liquid fuel escapes from the injection chamber 20 via a blind bore 34 into the first nozzle needle 7 and via at least one injection opening 35 into the combustion chamber 29 of the internal combustion engine. After a stroke travel h of the second nozzle needle 8, the latter reaches an upper switching position and bears against a sealing seat 38 (see FIG. 2(*b*)). Here, the sealing seat 38 is formed on the valve element 14, which is of multiply stepped form on the outer circumference. In this way, a partial chamber 45 of the injection chamber 20 is formed, wherein the inflow throttle 36 opens into said partial chamber 45. Here, the throughflow ratio between the inflow throttle 36 and the flow through the at least one injection opening 35 is selected such that the first nozzle needle 7 moves upward only when the second nozzle needle 8 has reached the sealing seat 38. When the sealing seat 38 is reached, the second nozzle needle 8 closes the inflow throttle 36, which leads to a pressure drop in the injection chamber 20. The resultant forces on the first nozzle needle now no longer act in a closing direction but rather, with the aid of the spring 39, close the first nozzle needle 7 to lift off in the direction of the inner pole 5. The opening-up of the injection cross section 27 leads to the introduction of preferably gaseous fuel into the combustion chamber 29 of the internal combustion engine. After a stroke travel H, the second nozzle needle 8 bears against the inner nozzle seat 25 of the first nozzle needle 7 in its upper switching position, and thus closes the at least one injection opening 35. The process of injection of liquid fuel into the combustion chamber 29 of the internal combustion engine is ended, as illustrated in FIG. 2(*c*). The liquid fuel still present in the injection chamber 20 is now fully isolated.

If the electrical energization of the magnet coil 33 is ended, the magnetic force that caused the magnet armature 6 to be pulled in the direction of the inner pole 5 is depleted. The surface, which is hydraulically active in a longitudinal direction and which is acted on by the pressure in the partial chamber 45 of the injection chamber 20, of that face side of the second nozzle needle 8 which is averted from the combustion chamber is now larger than the surface, which is hydraulically active in the longitudinal direction, on the second nozzle needle 8 in the presently isolated injection chamber 20. By means of the restoring force of the restoring spring 24 in the direction of the combustion chamber 29 on the second nozzle needle 8, the latter moves out of the sealing seat 38 in the direction of the combustion chamber 29. Pressure equalization occurs between the partial chamber 45 of the injection chamber 20 and the injection chamber 20, because the partial chamber 45 of the injection chamber 20 is incorporated into the injection chamber 20 again. The pressure in the gas chamber 30 and thus in the chamber 47 corresponds approximately to the pressure in the injection chamber 20, whereas the pressure in the prechamber 28 is lower owing to the open first nozzle needle 7. Owing to the thus resultant forces on the first nozzle needle 7, the first nozzle needle 7 moves in the direction of the injection cross section 27. The introduction of gaseous fuel into the combustion chamber 29 is thus ended.

Figure 3A:
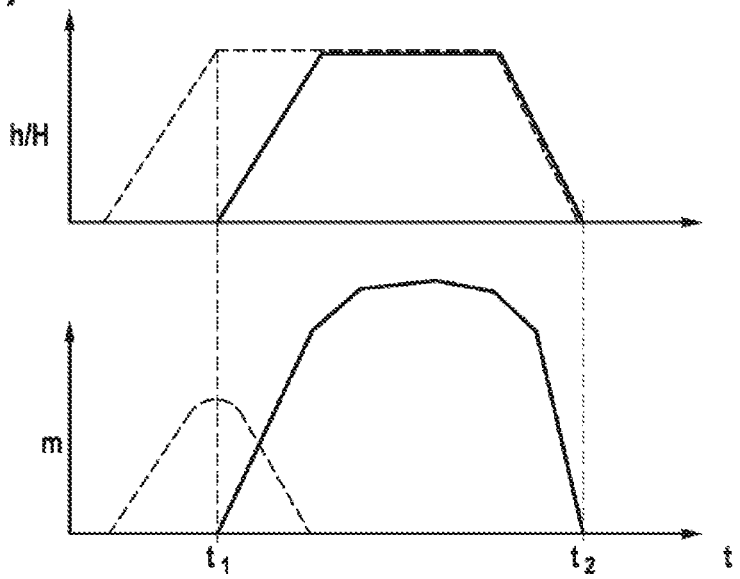
Figure 3B:
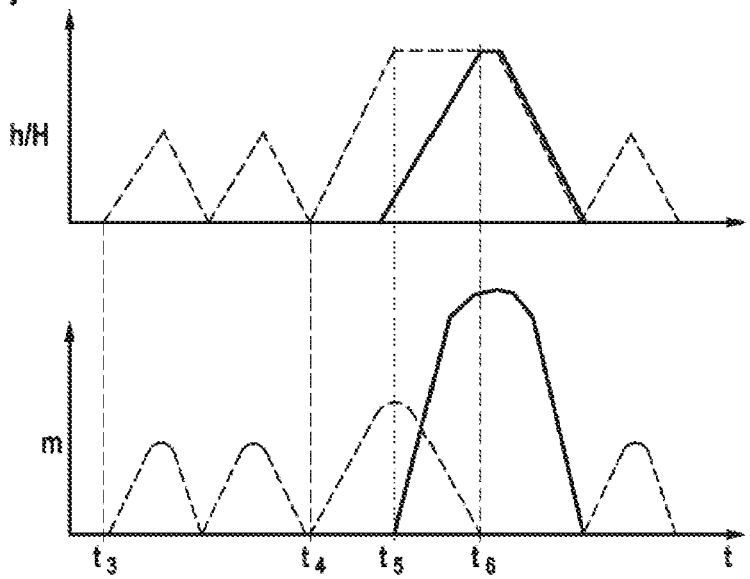

FIG. 3(*a*) illustrates the above-described injection process in a diagram in which the stroke travel H of the first nozzle needle 7 and the stroke travel h of the second nozzle needle 8 are plotted as a function of the time t. Furthermore, the injection quantity m of liquid and gaseous fuel is plotted as a function of the time t. The maximum stroke travel H of the second nozzle needle 8 is reached at the time $t_1$. At said time $t_1$, the first nozzle needle 7 begins to move in the direction of the magnet armature 6, and opens up the injection cross section 27. The maximum injection quantity m of liquid and gaseous fuel is in both cases reached when the first nozzle needle 7 and the second nozzle needle 8 respectively are in the upper switching position. After deactivation of the magnet coil 33, the first nozzle needle 7 and the second nozzle needle 8 together cover the negative stroke travel h and H respectively. The injection quantity m of gaseous fuel is reduced during the movement of the nozzle needle 7 and 8 in the direction of the combustion chamber 29, and is stopped at the time $t_2$ upon the closure of the injection cross section 27.

FIG. 3(*b*) illustrates an alternative form of injection of the fuel injector according to the invention. Here, the electrical energization of the magnet coil 33 is ended multiple times before the second nozzle needle 8 has reached the sealing seat 38. In this way, only small quantities m of liquid fuel are introduced into the combustion chamber 29. Only after the third electrical energization of the magnet coil 33 at the time $t_4$ is the maximum stroke travel H of the second nozzle needle 8 and thus the maximum injection quantity of liquid fuel reached. The injection of gaseous fuel now begins at the time $t_5$, when the first nozzle needle 7 moves in the direction of the second nozzle needle 8. When the maximum stroke travel H of the first nozzle needle 7 is reached at the time $t_6$, the maximum possible injection quantity m of gaseous fuel is injected into the combustion chamber 29. After the end of the electrical energization of the magnet coil, the first nozzle needle 7 and the second nozzle needle 8 together cover the negative stroke travel h and H respectively, and end the injection process. This is followed by a renewed electrical energization of the magnet coil, which is ended before the maximum stroke travel h of the second nozzle needle 8 is reached, and again only a small quantity m of liquid fuel is injected into the combustion chamber 29. This is only one possible form of injection of the fuel injector according to the invention. Multiple pre-injections and post-injections of liquid fuel may be performed.

What is claimed is:

1. A fuel injector for injecting two liquid and/or gaseous fuels, the fuel injector comprising an injector housing (1) which has a nozzle body (2) and a valve body (3), wherein, in the injector housing (1), there is a first nozzle needle (7) arranged such that the first nozzle needle can perform stroke movements for opening and closing an injection cross section (27), wherein the first nozzle needle (7) is formed as a hollow needle in which there is a second nozzle needle (8) arranged such that the second nozzle needle can perform stroke movements, wherein, for the purposes of opening and closing at least one injection opening (35), the second nozzle needle interacts with an inner nozzle seat (25) formed in the first nozzle needle, wherein the first nozzle needle (7) and the second nozzle needle (8) delimit an injection chamber (20) configured to be filled with fuel via an inflow throttle (36), characterized in that the second nozzle needle (8), in an upper switching position, bears against a sealing seat (38) and thereby shuts off a connection between the injection chamber (20) and the inflow throttle (36), wherein, in the interior of the valve body (3), there is arranged a valve element (14) which has a passage bore of multiply stepped form, into which the first nozzle needle (7) and the second nozzle needle (8) project, and wherein the inflow throttle (36) is formed in the valve element (14).

2. The fuel injector as claimed in claim 1, characterized in that the sealing seat (38) is formed on the valve element (14).

3. The fuel injector as claimed in claim 1, characterized in that the valve element (14) is forced in a direction of the nozzle body (2) by a spring (15).

4. The fuel injector as claimed in claim 1, characterized in that the first nozzle needle (7) is of stepped form on an outer circumference.

5. The fuel injector as claimed in claim 1, characterized in that the at least one injection opening (35) is formed on a face side of the first nozzle needle (7) which faces toward a combustion chamber (29).

6. The fuel injector as claimed in claim 1, characterized in that the inner nozzle seat (25) is formed on a face side of the first nozzle needle (7) which faces toward the combustion chamber.

7. The fuel injector as claimed in claim 1, characterized in that the nozzle body (2) and the first nozzle needle (7) delimit a prechamber (28) in which there is provided a spring (39) which forces the first nozzle needle (7) in a direction of the valve body (3).

8. The fuel injector as claimed in claim 7, characterized in that, in the prechamber (28), there is arranged a separating device (19), which separates the liquid and/or gaseous fuels from one another.

9. The fuel injector as claimed in claim 1, characterized in that the valve element (14) and the second nozzle needle (8), in the upper switching position, delimit a partial chamber (45) which forms a part of the injection chamber (20).

10. The fuel injector as claimed in claim 9, characterized in that the inflow throttle (36) opens into the partial chamber (45).

11. The fuel injector as claimed in claim 1, characterized in that the second nozzle needle (8) is forced in a direction of the inner nozzle seat (25) by a restoring spring (24).

12. The fuel injector as claimed in claim 1, characterized in that the first nozzle needle (7) controls a flow of a gaseous fuel into a combustion chamber (29).

13. The fuel injector as claimed in claim 1, characterized in that the second nozzle needle (8) controls a flow of a liquid fuel into a combustion chamber (29).

14. The fuel injector as claimed in claim 7, characterized in that, in the prechamber (28), there is arranged a diaphragm, which separates the liquid and/or gaseous fuels from one another.

15. The fuel injector as claimed in claim 1, wherein the valve element is separate from the first nozzle needle and the second nozzle needle, and wherein the first and second nozzle needles are movable relative to the valve element.

* * * * *